US005683341A

United States Patent [19]

Giebeler

[11] Patent Number: 5,683,341

[45] Date of Patent: Nov. 4, 1997

[54] QUILL SHAFT SUSPENSION FOR CENTRIFUGE ROTOR HAVING CENTRAL STATOR

[75] Inventor: Robert Giebeler, San Jose, Calif.

[73] Assignee: Piramoon Technologies, Inc., Santa Clara, Calif.

[21] Appl. No.: 616,068

[22] Filed: Mar. 14, 1996

[51] Int. Cl.[6] ..... B04B 5/02; B04B 9/00

[52] U.S. Cl. ..... 494/16; 494/84

[58] Field of Search ..... 494/12, 16, 33, 494/46, 82–85; 210/364, 365, 367, 380.1; 74/572, 574

[56] References Cited

U.S. PATENT DOCUMENTS

| | | | |
|---|---|---|---|
| 1,679,890 | 8/1928 | Baldwin | 494/46 X |
| 3,676,723 | 7/1972 | Drucker | 494/16 X |
| 3,770,191 | 11/1973 | Blum | 494/46 |
| 3,938,354 | 2/1976 | Lehman | 494/84 X |
| 4,201,066 | 5/1980 | Nolan, Jr. | 494/46 X |
| 4,226,669 | 10/1980 | Vilardi | 494/16 X |
| 4,568,324 | 2/1986 | Williams | 494/82 |
| 5,026,341 | 6/1991 | Giebeler | 494/82 |
| 5,342,282 | 8/1994 | Letourneur | 494/16 X |
| 5,505,684 | 4/1996 | Piramoon | 494/16 |

*Primary Examiner*—Charles E. Cooley

*Attorney, Agent, or Firm*—Townsend and Townsend and Crew LLP

[57] ABSTRACT

In a centrifuge having a central stator with a peripheral rotor, an improved suspension for the rotor is disclosed. The central stator is provided with a bore coaxial to the axis of rotation of the rotor. The rotor of the centrifuge motor has a quill shaft support member extending into and rotating within the coaxial bore of the stator. A quill shaft attaches at the bottom of the quill shaft support member and extends upward above the rotor of the centrifuge motor to support a fastening hub for the centrifuge rotor. The rotor of the centrifuge is detached from the rotor of the centrifuge motor so as to define a spatial interval between the supported spinning rotor and the rotor of the motor driving the centrifuge. The centrifuge rotor attaches at the hub and depends downward from the hub with the spatial interval being defined between the rotor of the motor and the rotor of the centrifuge. It is noted that the center of gravity of the attached centrifuge rotor is well below the hub so that support of the rotor is inherently stable. In the preferred embodiment, heat transfer shielding material is placed over the rotor of the motor. Operation is quite and smooth with the inevitable rotor imbalances being absorbed by quill shaft flexure.

8 Claims, 4 Drawing Sheets

QUILL SHAFT SUSPENSION FOR CENTRIFUGE ROTOR HAVING CENTRAL STATOR

This invention relates to centrifuges. More particularly, in CENTRIFUGE CONSTRUCTION HAVING CENTRAL STATOR filed Aug. 10, 1994 as Ser. No.: 08/288,387, now U.S. Pat. No. 5,505,684, issued Apr. 6, 1996 there was disclosed a centrifuge having a central stator with a peripheral rotor. The present invention is an improvement on that device and discloses rotor support utilizing a quill shaft supporting the rotor at a point well above the center of gravity of the rotor.

BACKGROUND OF THE INVENTION

Centrifuge construction of the prior art can be simply set forth. Referring to FIG. 1, such construction consists of the following:

1. Driving motor M is utilized consisting of an exterior stator 14 and central and driven interior rotor 16, this rotor driving output shaft 18 from the motor;

2. Rotor support shaft H is present having supporting bearing 20 transmitting rotating force from output shaft 18 of driving motor M to both support and rotate prior art centrifuge rotor $R_O$ at male coupling 22;

3. Usually, transmission T is provided between output shaft 18 of driving motor M and rotor support shaft H, this transmission consisting either of a belt and pulley drive or suitable gearing; and, 4. Prior art centrifuge rotor $R_O$ is supported at female coupling 24 matching to male coupling 22 of rotor support shaft H. Prior art centrifuge rotor $R_O$ is cylindrical. As in all centrifuges, sample to be centrifuged is contained in the rotor. Here, sample tubes 26 are provided to hold samples 28 undergoing centrifugation. Alternatively, rotor modification can be present for either batch centrifugation or the continuous circulation of materials to be centrifuged to and from the rotor during centrifugation.

The primary difficulty of the prior art is vibration from the combination of the driving motor M, rotor support shaft H, and prior art centrifuge rotor $R_O$ as the rotor undergoes high speed rotation. A discussion of the types of vibration can be helpful. Rotation ranges of centrifuge rotors can include up to 6,000 rpms for low speed centrifuges, up to 30,000 rpms for high speed centrifuges, and even up to 120,000 rpms for ultra-centrifuges.

Referring further to FIG. 1, rotor support shaft H will be seen to provide a columnar support of prior art centrifuge rotor $R_O$ from supporting bearing 20. Specifically, assume that a rotor imbalance exists. Such would be the case where the center of gravity of the rotor is not co-incident to the spin axis of the rotor. During rotation of such a rotor, rotor support shaft H will be bent in a plane normal to the spin axis of the rotor from supporting bearing 20. This will cause transverse shaft vibration 30. When rotor support shaft H and supporting bearing 20 undergoes stress, accumulated to a sufficient degree, it can cause centrifuge failure.

It is known that if prior art centrifuge rotor $R_O$ has imbalance in a vertical plane, rapid stress reversal in rotor support shaft H can occur. Simply stated, if prior art centrifuge rotor $R_O$ has imbalance in a vertical plane, the rotor bends rotor support shaft H each time the support shaft rotates with shaft stress reversing vibration 32. This shaft stress reversing vibration 32 is transmitted directly through male coupling 22 and female coupling 24 to rotor support shaft H.

Stress reversals on a rapidly rotating shaft accumulate over a relatively short operating lifetime cause premature fatigue failures in the metallic structure of the shaft. When it is remembered that any kind of a failure in a high speed rotating centrifuge shaft is catastrophic—usually causing disintegration of the high speed rotor—such vibrations are to be carefully avoided.

To these vibrational components can be added torsional vibrations between driving motor M and prior art centrifuge rotor $R_O$. Specifically, driving motor M, either alone or through transmission T, can provide an irregular rotating force to prior art centrifuge rotor $R_O$. For example, driving motor M can provide an irregular rotating force which contains small torsional accelerations and decelerations. This irregular rotating force can superimpose a torsional vibration upon the high speed rotation of the centrifuge. Typically, central and driven interior rotor 16 of driving motor M torsionally vibrates with respect to prior art centrifuge rotor $R_O$. This torsional vibration is translated between prior art centrifuge rotor $R_O$ and central and driven interior rotor 16 of driving motor M through male coupling 22 and female coupling 24 to rotor support shaft H, transmission T, output shaft 18. Again, the system undergoes vibrational stress—this time in torsion.

The vibrational modes set forth above are relatively simple to explain, but extremely difficult to eliminate as a practical matter. Specifically, these vibrational modes are usually not confined to a single frequency, but include many frequencies. Further, it is well known that such vibrational frequencies "resonate" at certain "critical" frequencies. For example, a change of a rotor—for example substituting a light rotor for a heavy rotor—can change the critical frequency at which the centrifuge drive vibrates. A centrifuge which does not appreciably vibrate with one rotor, can be found to vibrate excessively with another rotor. Consequently, replacement rotor design can be adversely affected by vibrational considerations.

As a direct result of these vibrational modes and generated forces, it is common for centrifuge manufacturers to retain whole engineering departments for the suppression of such vibrations.

In CENTRIFUGE CONSTRUCTION HAVING CENTRAL STATOR filed Aug. 10, 1994 as Ser. No.: 08/288,387, now U.S. Pat. No. 5,505,684, issued Apr. 6, 1996 a centrifuge construction is disclosed in which a centrally located stator directly drives a peripheral ring shaped centrifuge rotor. In the preferred embodiment, a centrifuge drive is disclosed which includes a stationary, central and usually cylindrical stator having stationary electrical windings to electrically commute magnetic field through the rotor, in order to rotate the rotor about the vertical axes. The ring shaped centrifuge rotor is supported by at least one bearing relative to the stator and includes a large central aperture defined by the inside of the ring which enables the rotor to fit over and rotate about the stator. At portions of the rotor adjoining the stator, the rotor is constructed from materials which are entrained by the rotating magnetic field. Four windings for 2-phase commutation where the poles of the stator are energized as pairs of adjacent poles having opposite polarities so as to create a magnetic circuit between each of the pole pairs. In the usual case, this large central aperture in the rotor requires the use of composite materials in the rotor to resist radial centrifugal forces generated during centrifugation with hoop stress resistance from wound composite material fibers. This application is accordingly incorporated herein by reference as if fully set forth herein.

Over the prior art, many centrifuge components are eliminated. Specifically, the separate driving motor and its central and driven interior rotor and output shaft are eliminated. Further, the rotor support shaft, the transmission mechanism, the male rotor coupling, and the female rotor coupling are no longer required. In place and instead of these multiple components there is provided the single central and stationary stator, a magnetically driven and rotating ring shaped central centrifuge rotor, and at least one bearing between the central stationary stator and the outer directly driven centrifuge rotor.

Referring to FIG. 2, the apparatus of CENTRIFUGE CONSTRUCTION HAVING CENTRAL STATOR filed Aug. 10, 1994 as Ser. No.: 08/288,387, now U.S. Pat. No. 5,505,684, issued Apr. 6, 1996 is disclosed. Central stationary stator S is illustrated. In the preferred embodiment, central stationary stator S is cylindrical and mounted to base B of the centrifuge.

Central stationary stator S here includes four electrical windings 40A–40D. As illustrated in FIG. 2, these respective windings are connected to variable reluctance motor controller/driver such as that manufactured by Semifusion of Morgan Hill, Calif. Wiring is conventional; the only difference is that central stationary stator S is not peripheral to rotor R, it is central to rotor R.

Rotor R is easy to understand. It includes a large central aperture A. Like central stationary stator S, large central aperture A is cylindrical and slightly exceeds the dimension of central stationary stator S. When rotor R is placed over central stationary stator S, clearance is defined between central stationary stator S and rotor R at the inside of large central aperture A.

It is to be understood that central stationary status S produces torque following the principles of variable reluctance motors. As will be seen, rotor R, having high magnetic permeability, rotates in synchrony with angular position of status with respect to rotor.

Rotor R is typically supported for rotation on central stationary stator S by at least one bearing. In the embodiment here shown, first top bearing $G_1$ and second bottom bearing $G_2$ are used (see FIGS. 8 and 9). These respective bearings enable substantially friction free rotation of rotor R relative to central stationary stator S. It will be noted that bottom bearing $G_2$ provides both vertical and radial support while top bearing $G_1$ provides radial support for rotor R.

Given the combination of top bearing $G_1$ and bottom bearing $G_2$ it will be understood that a design having high resistance to rotor imbalance is disclosed. Specifically, central stationary stator S because of its large cylindrical diameter is a highly stable member for attachment of top bearing $G_1$ and bottom bearing $G_2$.

Tests with this new centrifuge design have revealed a major problem. Specifically, where any kind of rotor imbalance exists, the large single central stator resists such vibration rigidly and the vibration effectively limits the speed of centrifuge to about 5,000 rpms. This disclosure is a solution to that discovery.

SUMMARY OF THE INVENTION

In a centrifuge having a central stator with a peripheral rotor, an improved suspension for the rotor is disclosed. The central stator is provided with a bore coaxial to the axis of rotation of the rotor. The rotor of the centrifuge motor has a quill shaft support member extending into and rotating within the coaxial bore of the stator. A quill shaft attaches at the bottom of the quill shaft support member and extends upward above the rotor of the centrifuge motor to support a fastening hub for the centrifuge rotor. The rotor of the centrifuge is detached from the rotor of the centrifuge motor so as to define a spatial interval between the supported spinning rotor and the rotor of the motor driving the centrifuge. The centrifuge rotor attaches at the hub and depends downward from the hub with the spatial interval being defined between the rotor of the motor and the rotor of the centrifuge. It is noted that the center of gravity of the attached centrifuge rotor is well below the hub so that support of the rotor is inherently stable. In the preferred embodiment, heat transfer shielding material is placed over the rotor of the motor. Operation is quite and smooth with the inevitable rotor imbalances being absorbed by quill shaft flexure.

DESCRIPTION OF THE PREFERRED EMBODIMENT

Figure 3:
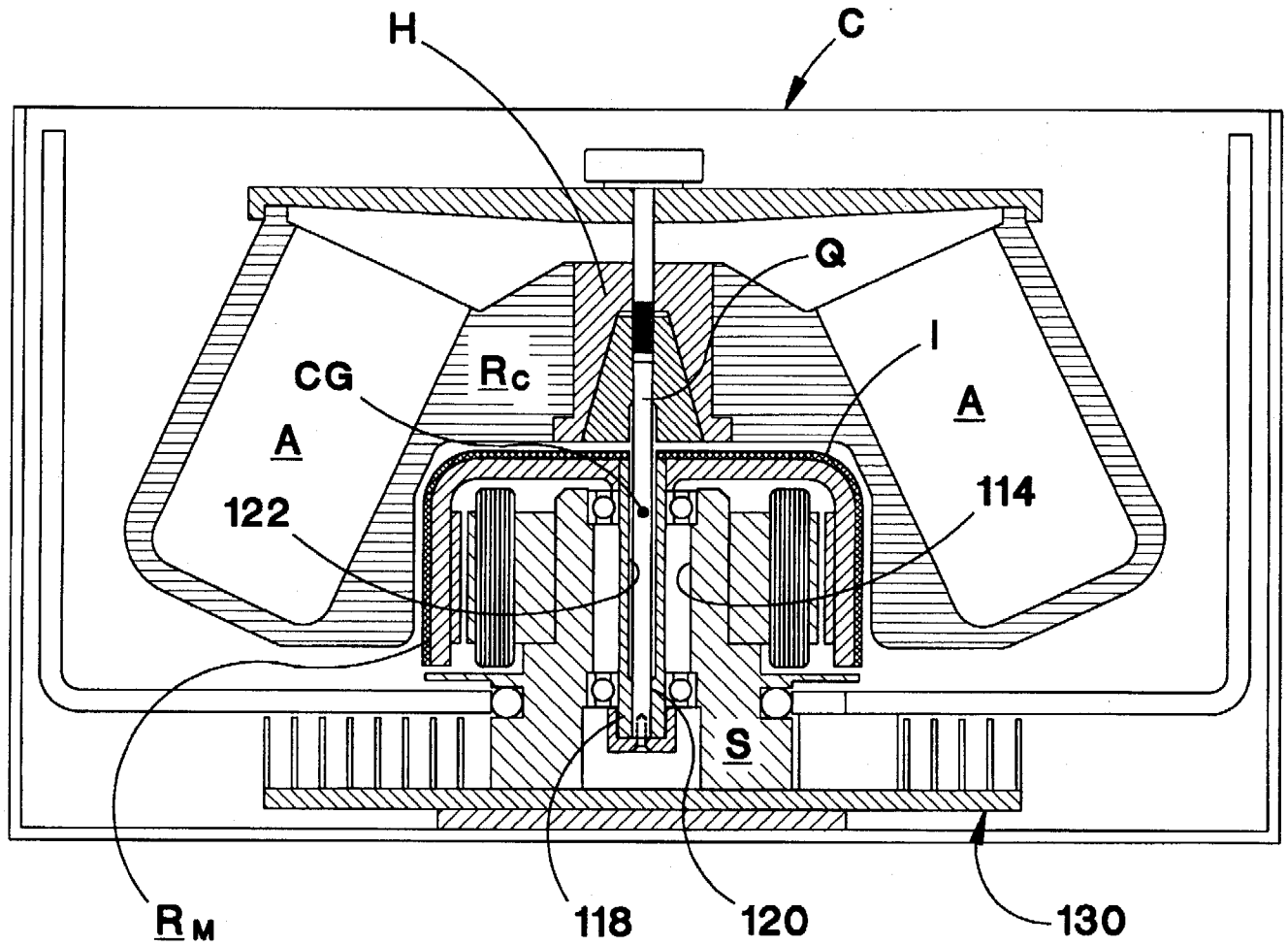
FIG. 3 is a side elevation section of the central quill shaft support illustrating the central stator bore, the rotating quill shaft support member extending into the central stator bore, the quill shaft supported at the bottom by the quill shaft support member and supporting at the top the hub for the rotor, and the supported rotor depending from the quill shaft supported hub around the motor stator and rotor; and, FIG. 4 is a schematic of the invention illustrating the separate dynamic systems of the motor, the quill shaft suspended rotor, and the quill shaft interconnecting the two systems.

Referring to FIG. 3, the improved centrifuge C is illustrated. Centrifuge rotor $R_C$ is shown mounted concentrically over motor rotor $R_M$. Centrifuge rotor $R_C$ is shown in section having sample tube apertures A defined within the body of centrifuge rotor $R_C$. It will be seen that centrifuge rotor $R_C$ is separated from motor rotor $R_M$ by a small spatial interval. This small interval of separation is required.

Stator S has a central cylindrical aperture 114 concentric to both the spin axis of motor rotor $R_M$ and centrifuge rotor $R_C$. Protruding from motor rotor $R_M$ into central cylindrical aperture 114 is quill shaft supporting member 118. Quill shaft supporting member 118 includes bottom quill shaft support section 120 and upper expanded bore section 122. As will hereafter become more apparent, upper expanded bore section 122 enables quill shaft Q to flex during simultaneous rotation of motor rotor $R_M$ and centrifuge rotor $R_C$.

Quill shaft Q is firmly supported from quill shaft supporting member 118 at bottom quill shaft support section 120. Quill shaft Q is small in diameter—on the order of ⅛ inch for centrifuge rotor $R_C$ having a diameter in the order of 10 inches. Preferably, quill shaft Q is of spring steel and is flexible.

Quill shaft Q supports at the upper end thereof rotor hub H. Rotor hub H is the member to which centrifuge rotor $R_C$ attaches. Thus quill shaft Q must be sufficient stiff to resist columnar bending when the full weight of centrifuge rotor $R_C$ is placed upon quill shaft Q.

It will be understood that stator S generates heat during operation of centrifuge C. This being the case, motor rotor $R_M$ is covered with heat insulation I to prevent heat transfer to centrifuge rotor $R_C$. This insulation I causes heat from stator S to be expelled to heat sink 130 underlying centrifuge C.

Figure 1:
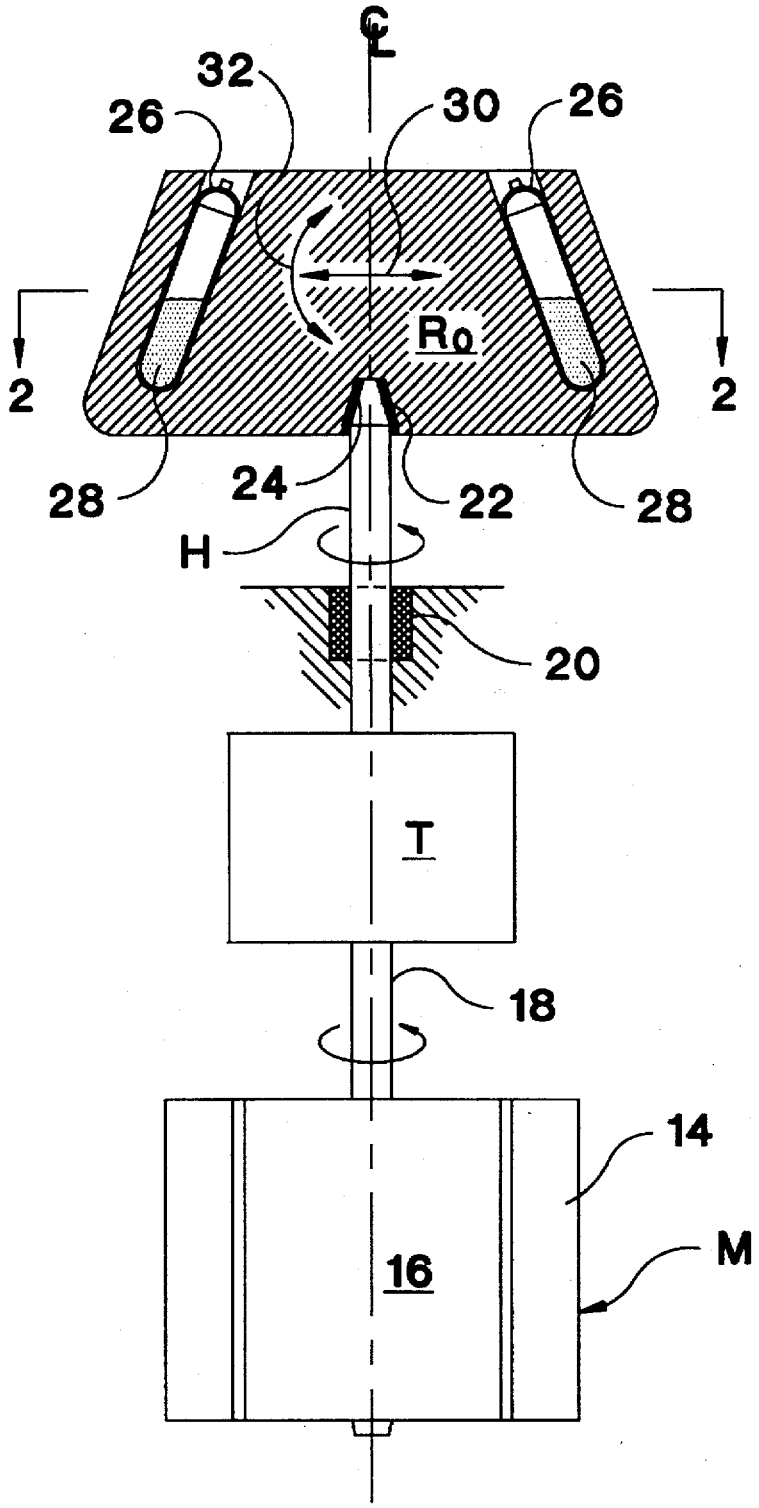
FIGURE 1 (PRIOR ART)
FIG. 1 is a schematic of a conventional centrifuge of the prior art illustrating the main components of such a centrifuge.
Figure 2:
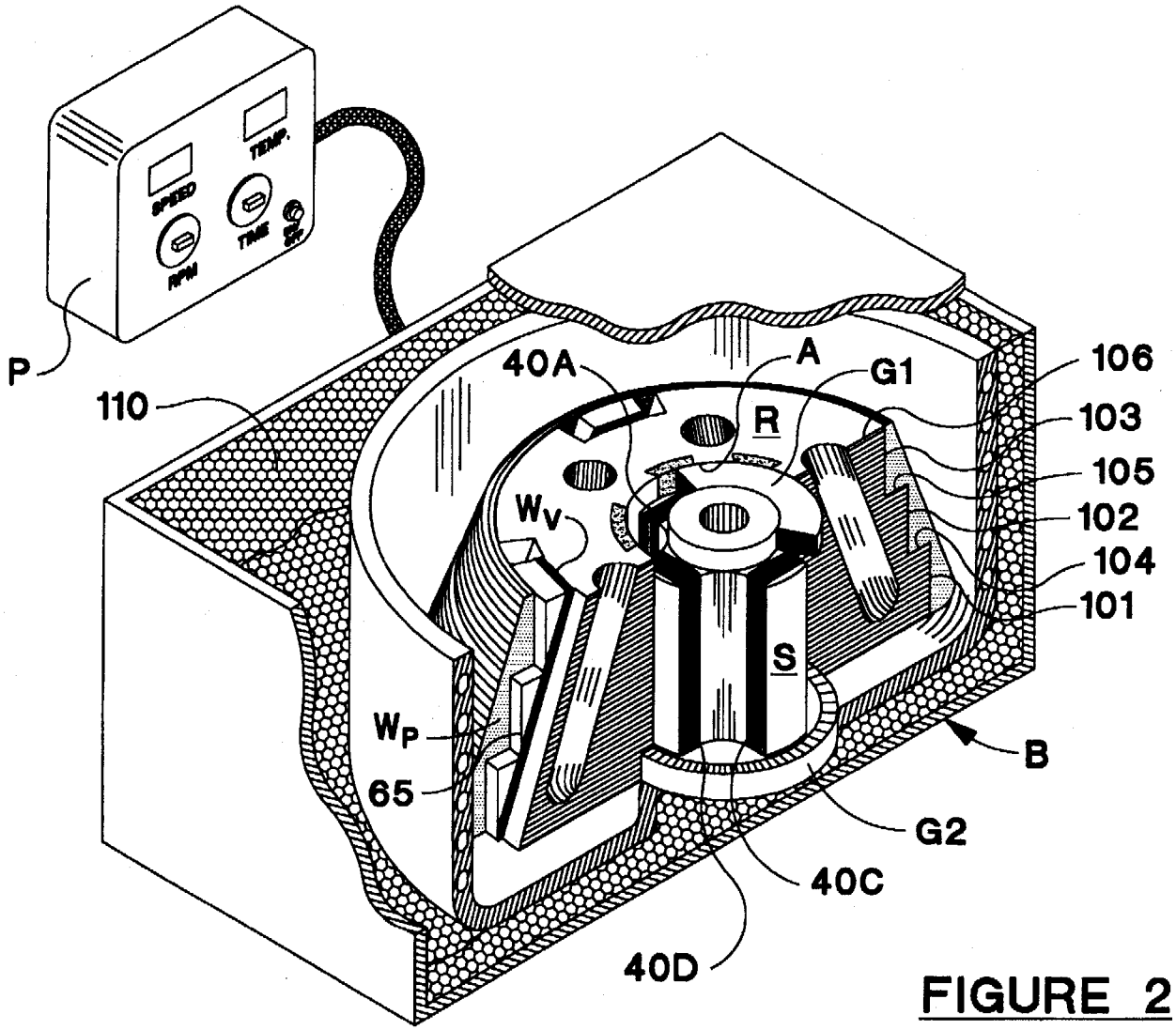
FIGURE 2 (PRIOR ART)
FIG. 2 is a perspective section at the spin axis of the centrifuge shown in CENTRIFUGE CONSTRUCTION HAVING CENTRAL STATOR filed Aug. 10, 1994 as Ser. No. 08/288,387, now U.S. Pat. No. 5,505,684, issued Apr. 6, 1996 illustrating a complete centrifuge according to this invention having additionally a stator drive, and a surrounding honeycomb barrier for providing the required safety configuration to absorb the possible forces of rotor disintegration.

It is to be noted, that center of gravity $C_G$ of centrifuge rotor $R_C$ is located roughly one third the height of the centrifuge rotor from the bottom of the rotor. At the same time, it will be observed that rotor hub H form a point of pendulous support for centrifuge rotor $R_C$. Thus, and unlike the prior art centrifuge of FIG. 1, support of the rotor is inherently stable—with center of gravity $C_G$ below rotor hub H instead of above the rotor hub.

Operation is readily understood. Presuming that centrifuge rotor $R_C$ is minutely out of balance—this rotor will have a center of gravity that is not exactly coincident with spin axis. Centrifuge rotor $R_C$ will attempt to spin about this center of gravity. And quill shaft Q will permit this spinning to occur!

Actual experiments with the illustrated apparatus have been surprising. I have seen a centrifuge rotor spin at 25,000 rpm on the illustrated support system. So-called vibration "criticals" are easily passed. When placed within a vacuum, the system runs in virtual quiet with only slight motor bearing noise being audible.

Figure 4:
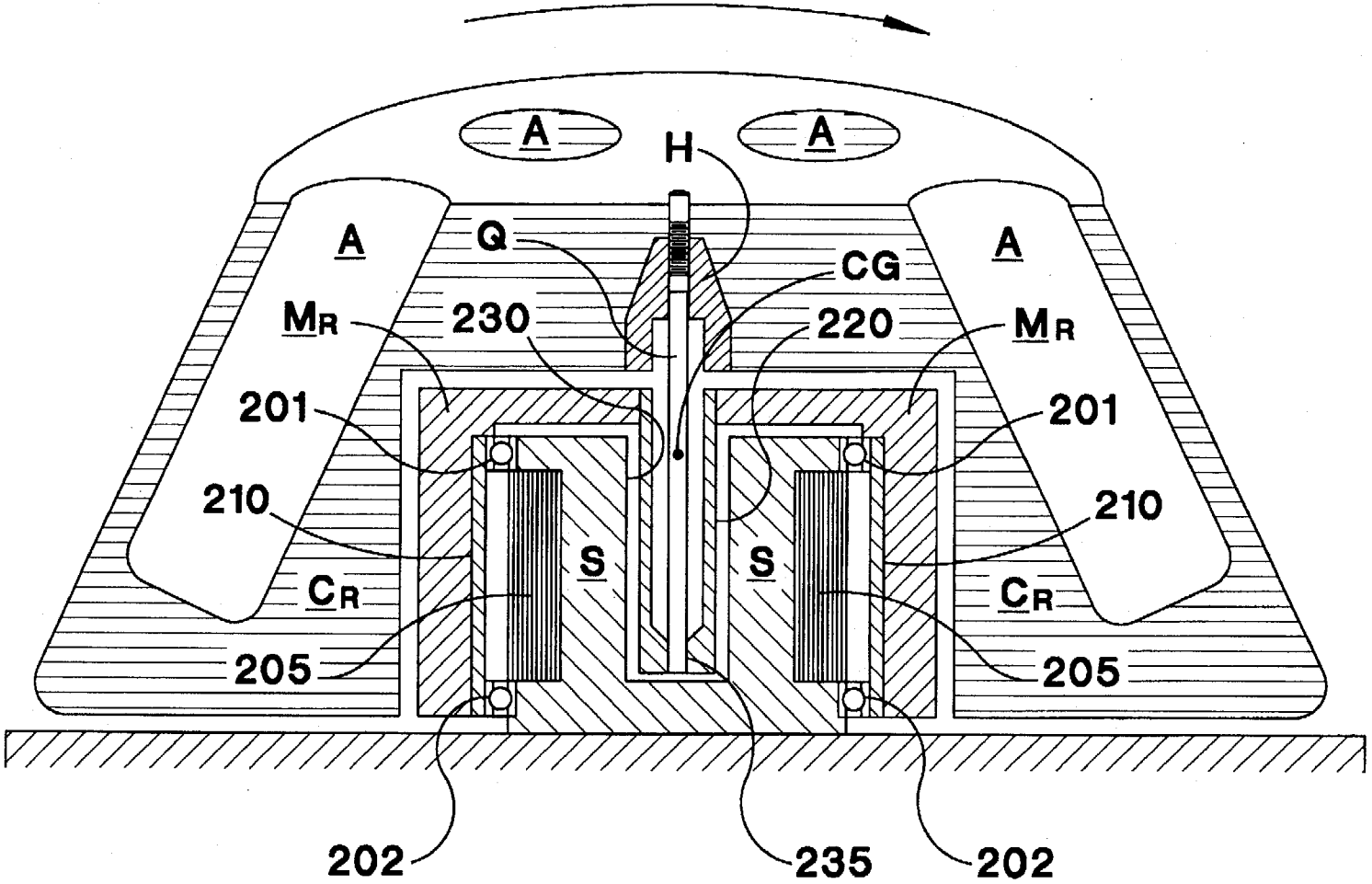

Referring to FIG. 4, the system can be simply seen. Central stator S supports motor rotor $M_R$ at top bearings 201 and bottom bearings 202. In the DC brushless motor illustrated, central stator S includes windings 205 which generate a rotating magnetic field. Motor rotor $M_R$ follows that rotation producing the desired rotation. This is a single, dynamic system consisting only of the centrifuge motor.

Centrifuge rotor $C_R$ constitutes the remaining dynamic system. It includes sample tube apertures A and a supporting hub H.

Quill shaft Q interconnects the two separate dynamic systems. Specifically, motor rotor $M_R$ has depending sleeve 220 that rotates interiorly of stator central bore 230. Depending sleeve 220 supports quill shaft Q at bottom connection 235.

Quill shaft Q supports centrifuge rotor $C_R$ at hub H. This support occurs at the upper end of quill shaft Q.

It is to be noted that the center of gravity of centrifuge rotor $C_R$ is well below hub H. Thus centrifuge rotor $C_R$ is inherently stable in its support on quill shaft Q.

Operation of the described system has proven surprisingly satisfactory. Rotation at speeds up to 25,000 rpms have been achieved.

Regarding the quill shaft Q, some attention can be devoted the stiffness of the shaft. Taking the example of the shaft 22 of FIG. 1, this prior art shaft has much higher stiffness than quill shaft Q. Specifically, this shaft is sufficiently stiff so that rotor $R_O$ not only does not significantly bend shaft 22 but additionally enables rotor $R_R$ to be maintained vertically aligned even though some imbalance forces are present.

Quill shaft Q has a relatively low stiffness. Rotor $R_C$ is supported above its center of gravity; thus the forces of gravity acting on the rotor $R_C$ from hub H tend to keep the rotor upright. Consequently, quill shaft Q does not have to be sufficiently stiff to keep the rotor vertical.

Secondly, this lower stiffness quill shaft Q then permits rotor $R_C$ to effectively "find" its own center of gravity. Rotor $R_C$ can spin about a center of gravity displaced from quill shaft Q and have the quill shaft conform to that center of gravity with each rotation.

What is claimed is:

1. In a centrifuge including in combination:

a central stationary stator for producing a rotating magnetic field;

a rotor having a ring shaped portion mounted peripherally to the central stationary stator, the rotor including material entrained by the rotating magnetic field from the stator;

the rotor at the ring shaped portion mounted peripherally to the central stationary stator defining at least one aperture for receiving a sample for centrifugation; and, at least one bearing for mounting the rotor for rotation with respect to the stator; the improvement to the rotor comprising:

a central bore defined in the stator;

a first rotor portion attached for rotation to the stator;

a second rotor portion defining a central aperture for depending support about the first rotor portion;

a quill shaft support member attached to the first rotor portion and extending into the central bore of the stator;

a quill shaft having a top and a bottom, the quill shaft supported at the bottom by the quill shaft support member and extending upwardly out of the central bore of the stator at the top to a support point for the second rotor portion; and, means for attaching the second rotor portion to the top of the quill shaft.

2. In a centrifuge having:

a rotor for containing at least one sample to be centrifuged;

at least one bearing for supporting and rotating the rotor; and, a stator for generating a magnetic field to rotate the rotor on the bearing to centrifuge the sample; the improvement comprising:

a central bore defined in the stator;

a first rotor portion attached for rotation to the stator;

a second rotor portion defining a central aperture for depending support about the first rotor portion;

a quill shaft support member attached to the first rotor portion and extending into the central bore of the stator;

a quill shaft having a top and a bottom, the quill shaft supported at the bottom by the quill shaft support member and extending upwardly out of the central bore of the stator to a support point for the second rotor portion; and, means for attaching the second rotor portion to the top of the quill shaft.

3. In a centrifuge having:

a single central stator for producing a rotating magnetic field;

a rotor having a ring shaped portion extending around the single central stator for containing at least one sample to be centrifuged;

means to incorporate permanent magnets into the rotor to rotate with the rotating magnetic field; and, at least one bearing for supporting and rotating the rotor; the improvement to the rotor comprising:

the rotor at the ring shaped portion exterior to the stator containing the sample to be centrifuged;

a central bore defined in the stator;

a first rotor portion attached for rotation to the stator, the first rotor portion having a ring shaped portion to define a large single central aperture for rotating peripherally exterior of and about the stator;

a second rotor portion defining a central aperture for depending support about the first rotor portion;

a quill shaft support member attached to the first rotor portion and extending into the central bore of the stator;

a quill shaft having a top and a bottom, the quill shaft supported at the bottom by the quill shaft support member and extending upwardly out of the central bore of the stator to a support point for the second rotor portion; and, means for attaching the second rotor portion to the top of the quill shaft.

4. A rotor for a centrifuge having a single central stator with a central bore coaxial to an axis of rotor rotation, the rotor comprising in combination:

a first rotor portion attached for rotation to the stator, the first rotor portion having a ring shaped portion to define a large single central aperture for rotating peripherally exterior of and about the stator;

a second rotor portion defining a central aperture for depending support about the first rotor portion;

a quill shaft support member attached to the first rotor portion and extending into the central bore of the stator;

a quill shaft having a top and a bottom, the quill shaft supported at the bottom by the quill shaft support member and extending upwardly out of the central bore of the stator to a support point for the second rotor portion; and, means for attaching the second rotor portion to the top of the quill shaft.

5. In the combination of a centrifuge comprising:

a body;

a stator mounted to the body having a vertically extending, external circumferential surface;

a central bore defined interiorly of the stator;

means on the stator for generating a rotating magnetic field relative to the stator;

a rotor defining a vertical axis and having a vertically extending, internal circumferential surface positioned opposite and surrounding the stator;

a bearing, supported by at least one of the stator and the body, supporting the rotor for rotational movement about the vertical axis and around the stator;

the rotor including a centrifuge region for containing a material to be centrifuged; and, a controller/driver motor power driving the rotor about the vertical axis, the improvement to the centrifuge comprising in combination:

a first rotor portion attached for rotation to the stator, the first rotor portion having a ring shaped portion to define a large single central aperture for rotating peripherally exterior of and about the stator;

a second rotor portion defining a central aperture for depending support about the first rotor portion;

a quill shaft support member attached to the first rotor portion and extending into the central bore of the stator;

a quill shaft having a top and a bottom, the quill shaft supported at the bottom by the quill shaft support member and extending upwardly out of the central bore of the stator to a support point for the second rotor portion; and, means for attaching the second rotor portion to the top of the quill shaft.

6. A centrifuge comprising:

a central stationary stator for producing a rotating magnetic field;

a rotor defining a vertical axis and having a vertically extending, internal circumferential surface positioned opposite and surrounding the stator;

the rotor mounted peripherally to the central stationary stator defining at least one aperture for receiving a sample for centrifugation; and, at least one bearing for mounting the rotor for rotation with respect to the stator;

the improvement to the centrifuge comprising in combination:

the stator defining a central bore coaxial to the vertical axis of rotation of the rotor about the stator;

a first rotor portion attached for rotation to the stator, the first rotor portion having a ring shaped portion to define a large single central aperture for rotating peripherally exterior of and about the stator;

a second rotor portion defining a central aperture for depending support about the first rotor portion;

a quill shaft support member attached to the first rotor portion and extending into the central bore of the stator;

a quill shaft having a top and a bottom, the quill shaft supported at the bottom by the quill shaft support member and extending upwardly out of the central bore of the stator to a support point for the second rotor portion; and, means for attaching the second rotor portion to the top of the quill shaft.

7. In a centrifuge having the combination including:

a rotor for containing at least one sample to be centrifuged;

at least one bearing for supporting and rotating the rotor; and, a stator for generating a rotating magnetic field to rotate the rotor on the bearing to centrifuged the sample; the improvement comprising:

a rotor defining a vertical axis and having a vertically extending, internal circumferential surface positioned opposite and surrounding the stator for fitting over the stator and rotating the at least one sample to be centrifuged peripherally about the stator; and, means attached to the rotor for coupling to the rotating magnetic field of the stator; the improvement comprising:

the stator defining a central bore coaxial to the vertical axis of rotation of the rotor about the stator;

a first rotor portion attached for rotation to the stator, the first rotor portion having a ring shaped portion to define a large single central aperture for rotating peripherally exterior of and about the stator;

a second rotor portion defining a central aperture for depending support about the first rotor portion;

a quill shaft support member attached to the first rotor portion and extending into the central bore of the stator;

a quill shaft having a top and a bottom, the quill shaft supported at the bottom by the quill shaft support member and extending upwardly out of the central bore of the stator to a support point for the second rotor portion; and, means for attaching the second rotor portion to the top of the quill shaft.

8. In a centrifuge having:

a single central stator for producing a rotating magnetic field, the stator defining a central bore;

a rotor for containing at least one sample to be centrifuged;

means to incorporate permanent magnets into the rotor to rotate with the rotating magnetic field;

at least one bearing for supporting and rotating the rotor; the improvement to the rotor comprising:

a first rotor portion attached for rotation to the stator, the first rotor portion having a ring shaped portion to define a large single central aperture for rotating peripherally exterior of and about the stator;

a second rotor portion defining a central aperture for depending support about the first rotor portion;

a quill shaft support member attached to the first rotor portion and extending into the central bore of the stator;

a quill shaft having a top and a bottom, the quill shaft supported at the bottom by the quill shaft support member and extending upwardly out of the central bore of the stator to a support point for the second rotor portion; and, means for attaching the second rotor portion to the top of the quill shaft.

* * * * *